US009287026B2

(12) United States Patent
Matsuura et al.

(10) Patent No.: US 9,287,026 B2
(45) **Date of Patent: *Mar. 15, 2016**

(54) MAGNETIC MATERIAL AND COIL COMPONENT

(75) Inventors: Hitoshi Matsuura, Tokyo (JP); Masahiro Hachiya, Tokyo (JP); Kenji Otake, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 153 days.

This patent is subject to a terminal disclaimer.

(21) Appl. No.: 14/114,138

(22) PCT Filed: Apr. 18, 2012

(86) PCT No.: PCT/JP2012/060408

§ 371 (c)(1),
(2), (4) Date: Nov. 7, 2013

(87) PCT Pub. No.: WO2012/147576

PCT Pub. Date: Nov. 1, 2012

(65) Prior Publication Data

US 2014/0132383 A1 May 15, 2014

(30) Foreign Application Priority Data

Apr. 27, 2011 (JP) ..... 2011-100095
Mar. 23, 2012 (JP) ..... 2012-068445

(51) Int. Cl.
*H01F 1/24* (2006.01)
*H01F 27/255* (2006.01)
(Continued)

(52) U.S. Cl.
CPC ..... *H01F 1/01* (2013.01); *B22F 1/0062* (2013.01); *B22F 1/0088* (2013.01); *B22F 1/02* (2013.01);
(Continued)

(58) Field of Classification Search
CPC ..... H01F 1/22; H01F 1/14766; H01F 1/33; H01F 41/0246
See application file for complete search history.

(56) References Cited

U.S. PATENT DOCUMENTS 2,193,768 A 3/1940 Masumoto et al.
4,129,444 A 12/1978 Dreyer et al.
(Continued)

FOREIGN PATENT DOCUMENTS

CN 1731542 A 2/2006
CN 101308719 A 11/2008
(Continued)

OTHER PUBLICATIONS

An Office Action issued by the Korean Intellectual Property Office, mailed Dec. 23, 2014, for Korean counterpart application No. 10-2013-7026362.
(Continued)

*Primary Examiner* — Carol M Koslow
(74) *Attorney, Agent, or Firm* — Law Office of Katsuhiro Arai

(57) ABSTRACT

An object is to provide a magnetic material and coil component offering improved magnetic permeability and insulation resistance, while also offering improved high-temperature load, moisture resistance, water absorbency, and other reliability characteristics at the same time. A magnetic material that has multiple metal grains constituted by Fe—Si-M soft magnetic alloy (where M is a metal element that oxidizes more easily than Fe), as well as oxide film constituted by an oxide of the soft magnetic alloy and formed on the surface of the metal grains, wherein the magnetic material has bonding parts where adjacent metal grains are bonded together via the oxide film formed on their surface, as well as bonding parts where metal grains are directly bonded together in areas having no oxide film, and resin material is filled in at least some of the voids generating as a result of accumulation of the metal grains.

8 Claims, 5 Drawing Sheets

(51) Int. Cl.

| | |
|---|---|
| ***C22C 33/02*** | (2006.01) |
| ***C22C 38/00*** | (2006.01) |
| ***B22F 1/02*** | (2006.01) |
| ***B22F 9/08*** | (2006.01) |
| ***B22F 3/00*** | (2006.01) |
| ***B22F 3/26*** | (2006.01) |
| ***H01F 1/01*** | (2006.01) |
| ***B22F 1/00*** | (2006.01) |
| ***C22C 1/04*** | (2006.01) |
| ***C22C 38/02*** | (2006.01) |
| ***C22C 38/18*** | (2006.01) |
| ***H01F 1/26*** | (2006.01) |
| ***H01F 1/33*** | (2006.01) |
| ***H01F 41/02*** | (2006.01) |
| *H01F 1/22* | (2006.01) |
| *H01F 1/147* | (2006.01) |
| *H01F 17/04* | (2006.01) |

(52) U.S. Cl.

CPC ..... *C22C 1/0458* (2013.01); *C22C 38/02* (2013.01); *C22C 38/18* (2013.01); *H01F 1/26* (2013.01); *H01F 1/33* (2013.01); *H01F 41/0246* (2013.01); *H01F 1/14766* (2013.01); *H01F 1/22* (2013.01); *H01F 1/24* (2013.01); *H01F 17/04* (2013.01)

(56) References Cited

U.S. PATENT DOCUMENTS

| | | | | |
|---|---|---|---|---|
| 4,921,763 | A | 5/1990 | Karamon | |
| 5,352,522 | A | 10/1994 | Kugimiya et al. | |
| 5,522,946 | A | 6/1996 | Tomita et al. | |
| 5,997,999 | A | 12/1999 | Horiuchi et al. | |
| 6,051,324 | A | 4/2000 | Moorhead et al. | |
| 6,392,525 | B1 | 5/2002 | Kato et al. | |
| 6,515,568 | B1 | 2/2003 | Maki et al. | |
| 6,764,643 | B2 | 7/2004 | Sagawa et al. | |
| 6,784,782 | B2 | 8/2004 | Inoue et al. | |
| 6,814,928 | B2 | 11/2004 | Sagawa et al. | |
| 7,422,697 | B2 | 9/2008 | Takahashi et al. | |
| 7,446,638 | B2 | 11/2008 | Nogi | |
| 7,719,399 | B2 | 5/2010 | Iwasaki | |
| 7,843,701 | B2 | 11/2010 | Kudo et al. | |
| 8,018,313 | B2 | 9/2011 | Tada et al. | |
| 8,416,051 | B2 * | 4/2013 | Matsuura et al. | 336/233 |
| 8,427,265 | B2 * | 4/2013 | Hachiya et al. | 336/83 |
| 8,866,579 | B2 | 10/2014 | Hachiya et al. | |
| 8,896,405 | B2 | 11/2014 | Hachiya et al. | |
| 2004/0086412 | A1 | 5/2004 | Suzuki et al. | |
| 2004/0140016 | A1 | 7/2004 | Sakamoto et al. | |
| 2004/0209120 | A1 | 10/2004 | Inoue et al. | |
| 2005/0199852 | A1 | 9/2005 | Takenoshita | |
| 2007/0159282 | A1 | 7/2007 | Huang et al. | |
| 2007/0290161 | A1 | 12/2007 | Tokuoka et al. | |
| 2008/0003126 | A1 | 1/2008 | Watanabe et al. | |
| 2008/0012679 | A1 | 1/2008 | Okabe et al. | |
| 2008/0029300 | A1 | 2/2008 | Harada et al. | |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2008/0278273 | A1 | 11/2008 | Lee et al. | |
| 2009/0003191 | A1 | 1/2009 | Inuzuka et al. | |
| 2009/0045905 | A1 | 2/2009 | Nakagawa et al. | |
| 2009/0102589 | A1 | 4/2009 | Lee et al. | |
| 2009/0140833 | A1 | 6/2009 | Tan et al. | |
| 2009/0184794 | A1 | 7/2009 | Tsuzuki et al. | |
| 2009/0302512 | A1 | 12/2009 | Gablenz et al. | |
| 2010/0033286 | A1 | 2/2010 | Katayama et al. | |
| 2010/0044618 | A1 | 2/2010 | Ishimine et al. | |
| 2010/0045120 | A1 | 2/2010 | Kitano et al. | |
| 2010/0253463 | A1 | 10/2010 | Shimomura et al. | |
| 2010/0287764 | A1 | 11/2010 | McGregor et al. | |
| 2010/0289609 | A1 | 11/2010 | Liao et al. | |
| 2011/0024670 | A1 | 2/2011 | Otsuki et al. | |
| 2011/0024671 | A1 | 2/2011 | Otsuki et al. | |
| 2011/0133881 | A1 | 6/2011 | Nakajima et al. | |
| 2011/0181384 | A1 | 7/2011 | Inuduka et al. | |
| 2011/0227690 | A1 | 9/2011 | Watanabe et al. | |
| 2011/0267167 | A1 | 11/2011 | Ogawa et al. | |
| 2011/0285486 | A1 | 11/2011 | Maeda et al. | |
| 2012/0001710 | A1 | 1/2012 | Wakabayashi et al. | |
| 2012/0038449 | A1 | 2/2012 | Ogawa et al. | |
| 2012/0070567 | A1 | 3/2012 | Watanabe et al. | |
| 2012/0229244 | A1 | 9/2012 | Ueno et al. | |
| 2013/0154786 | A1 | 6/2013 | Nakajima et al. | |
| 2013/0271256 | A1 | 10/2013 | Ueno et al. | |

FOREIGN PATENT DOCUMENTS

| | | | |
|---|---|---|---|
| CN | 101927344 | A | 12/2010 |
| CN | 102007549 | A | 4/2011 |
| JP | H04-147903 | A | 5/1992 |
| JP | H04-346204 | A | 12/1992 |
| JP | H07-201570 | A | 8/1995 |
| JP | H09-074011 | A | 3/1997 |
| JP | H10-241942 | A | 9/1998 |
| JP | 2000-030925 | A | 1/2000 |
| JP | 2000-138120 | A | 5/2000 |
| JP | 2001-011563 | A | 1/2001 |
| JP | 2001-118725 | A | 4/2001 |
| JP | 2002-305108 | A | 10/2002 |
| JP | 2002-313620 | A | 10/2002 |
| JP | 2002-313672 | A | 10/2002 |
| JP | 2002-343618 | A | 11/2002 |
| JP | 2004-162174 | A | 6/2004 |
| JP | 2005-150257 | A | 6/2005 |
| JP | 2005-286145 | A | 10/2005 |
| JP | 2007-019134 | A | 1/2007 |
| JP | 2007-027354 | A | 2/2007 |
| JP | 2007-123703 | A | 5/2007 |
| JP | 2007-258427 | A | 10/2007 |
| JP | 2007-299871 | A | 11/2007 |
| JP | 2008-028162 | A | 2/2008 |
| JP | 2008-041961 | A | 2/2008 |
| JP | 2008-195986 | A | 8/2008 |
| JP | 2009-010180 | A | 1/2009 |
| JP | 2009-088496 | A | 4/2009 |
| JP | 2009-088502 | A | 4/2009 |
| JP | 2010-018823 | A | 1/2010 |
| JP | 2011-249774 | A | 12/2011 |
| TW | 200845057 | A | 11/2008 |
| TW | M388724 | U1 | 9/2010 |
| WO | 2009/001641 | A1 | 12/2008 |
| WO | 2009/128425 | A1 | 10/2009 |
| WO | 2009/128427 | A1 | 10/2009 |
| WO | 2010/013843 | A1 | 2/2010 |
| WO | 2011/001958 | A1 | 1/2011 |

OTHER PUBLICATIONS

Final Rejection issued by U.S. Patent and Trademark Office, dated Mar. 2, 2015, for related U.S. Appl. No. 14/162,427.

A Notification of Examination Opinions with Search Report issued by Taiwan Intellectual Property Office, mailed Feb. 10, 2014, for Taiwan counterpart application No. 100141341.

A Notification of Examination Opinions with Search Report issued by Taiwan Intellectual Property Office, mailed Mar. 25, 2014, for Taiwan counterpart application No. 101112339.

A Notification of Reasons for Refusal issued by the Japanese Patent Office, mailed Jun. 9, 2014, for Japanese counterpart application No. 2013-511866.

A European Office Action, mailed May 20, 2014, issued for a counterpart European Application No. 12002109.

Non-Final Rejection issued by U.S. Patent and Trademark Office, dated Aug. 25, 2014, for co-pending U.S. Appl. No. 14/113,801.

Non-Final Rejection issued by U.S. Patent and Trademark Office, dated Aug. 25, 2014, for co-pending U.S. Appl. No. 14/162,427.

International Search Report mailed Jul. 3, 2012, issued for International application No. PCT/JP2012/060408.

(56) References Cited

OTHER PUBLICATIONS

Notification of Transmittal of Translation of the International Preliminary Report on Patentability (PCT/IB/338) mailed Nov. 7, 2013, with International Preliminary Report on Patentability (PCT/IB/373) and Written Opinion of the International Searching Authority (PCT/ISA/237), for corresponding international application PCT/JP2012/060408.

* cited by examiner

MAGNETIC MATERIAL AND COIL COMPONENT

This application is the U.S. National Phase under 35 U.S.C. §371 of International Application PCT/ JP2012/060408, filed Apr. 18, 2012, which claims priority to Japanese Patent Applications No. 2011-100095, filed Apr. 27, 2011, and No. 2012-068445, filed Mar. 23, 2012. The International Application was published under PCT Article 21(2) in a language other than English.

TECHNICAL FIELD

The present invention relates to a magnetic material used primarily as a magnetic core in a coil, inductor, etc., as well as a coil component.

PRIOR ART

Coil components such as inductors, choke coils and transformers (so-called inductance components) have a magnetic material and a coil formed inside or on the surface of the magnetic material. For the magnetic material, Ni—Cu—Zn ferrite or other type of ferrite is generally used.

There has been a need for these coil components of larger current capacity (higher rated current) in recent years, and switching the magnetic material from ferrite as traditionally used, to Fe alloy, is being studied in order to meet such demand.

Patent Literature 1 discloses a method of manufacturing the magnetic material part of a laminated coil component, which is to form magnetic layers using a magnetic paste containing Fe—Cr—Si alloy grains and glass component, laminate the magnetic layers with conductive patterns and sinter the laminate in a nitrogen ambience (reducing ambience), and then impregnate the sintered laminate with thermosetting resin.

PRIOR ART LITERATURES

Patent Literature

Patent Literature 1: Japanese Patent Laid-open No. 2007-027354

SUMMARY OF THE INVENTION

Problems to be Solved by the Invention

However, the invention in Patent Literature 1 adopts a composite structure of metal powder and resin to ensure insulation property, and therefore sufficient magnetic permeability cannot be achieved. Also, heat treatment must be performed at low temperature to keep the integrity of resin, which prevents the Ag electrode from becoming denser and consequently sufficient L and Rdc characteristics cannot be achieved.

In addition, insulation treatment must be applied, given the low insulation property of the metal magnetic material itself. Improvement of reliability characteristics is desired, as well.

In consideration of the above, an object of the present invention is to provide a magnetic material and coil component offering improved magnetic permeability and insulation resistance, while also offering improved high-temperature load, moisture resistance, water absorbency and other reliability characteristics at the same time.

Means for Solving the Problems

After studying in earnest, the inventors completed the present invention described below.

The magnetic material proposed by the present invention has multiple metal grains constituted by Fe—Si-M soft magnetic alloy (where M is a metal element that oxidizes more easily than Fe), as well as oxide film formed on the surface of the metal grains. This oxide film is constituted by an oxide of the soft magnetic alloy itself. The magnetic material has bonding parts where adjacent metal grains are bonded together via the oxide film formed on their surface, as well as bonding parts where metal grains are directly bonded together in areas having no oxide film. And, resin material is filled in at least some of the voids generating as a result of accumulation of the metal grains.

Preferably the resin material is filled in regions whose area corresponds to 15% or more of the area of the regions where neither the metal grain nor oxide film is present, as observed on a cross section of the magnetic material. Also, preferably the resin material is constituted by at least one type of resin selected from a group that includes silicone resin, epoxy resin, phenolic resin, silicate resin, urethane resin, imide resin, acrylic resin, polyester resin, and polyethylene resin.

According to the present invention, a coil component having the aforementioned magnetic material and a coil formed inside or on the surface of the magnetic material is also provided.

Effect of the Invention

According to the present invention, a magnetic material offering both high magnetic permeability and high insulation resistance, and low water absorbency and high reliability is provided.

MODES FOR CARRYING OUT THE INVENTION

Figure 1:
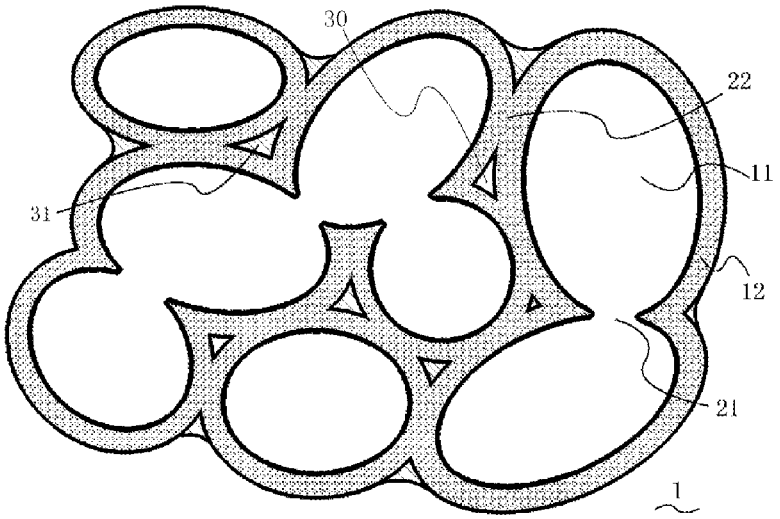
[FIG. 1] This is a section view providing a schematic illustration of the fine structure of a magnetic material conforming to the present invention.

The present invention is described in detail by referring to the drawings as appropriate. It should be noted, however, that the present invention is not at all limited to the illustrated embodiments and that, because the characteristic parts of the invention may be emphasized in the drawings, the scale of each part of the drawings is not necessarily accurate.

According to the present invention, the magnetic material is constituted by a grain compact, which is made by specified grains accumulated in a specified bonding style.

Under the present invention, the magnetic material is what functions as a magnetic path in a coil, inductor, or other magnetic component, and typically takes the form of a magnetic core of a coil, etc.

FIG. 1 is a section view providing a schematic illustration of the fine structure of a magnetic material conforming to the present invention. Under the present invention, microscopically a magnetic material 1 is understood as an aggregate of many metal grains 11 that were originally independent, where the individual metal grains 11 have oxide film 12 formed at least partially around them or preferably almost all around them and this oxide film 12 ensures insulation property of the magnetic material 1. Adjacent metal grains 11 are bonded together primarily via the oxide film 12 around the respective metal grains 11, to constitute the magnetic material 1 having a specific shape. In addition to bonds 22 that interconnect oxide films 12, bonds 21 that interconnect the metal parts of adjacent metal grains 11 also exist in some areas. Conventional magnetic materials include those constituted by individual magnetic grains or several magnetic grain bonds dispersed in a matrix of hardened organic resin, or others constituted by individual magnetic grains or several magnetic grain bonds dispersed in a matrix of hardened glass component.

As described later, the magnetic material 1 contains resin material, but the resin material only exists to the extent of filling the voids between metal grains, and the bonding elements that shape the magnetic material 1 are the two types of bonds 21 and 22 mentioned above. Even when the parts where the resin material exists are excluded from the magnetic material 1, continuous structures due to the two types of bonds 21, 22 mentioned above are still seen. Under the present invention, preferably virtually no matrix of glass component exists.

The individual metal grains 11 are primarily constituted by specific soft magnetic alloy. Under the present invention, the metal grain 11 is constituted by Fe—Si-M soft magnetic alloy. Here, M is a metal element that oxidizes more easily than Fe, and typically Cr (chromium), Al (aluminum), Ti (titanium), etc., and preferably Cr or Al.

When the soft magnetic alloy is Fe—Cr—Si alloy, the content of Si is preferably 0.5 to 7.0 percent by weight, or more preferably 2.0 to 5.0 percent by weight. A higher Si content is preferable in that it leads to higher resistance and higher magnetic permeability, while a lower Si content is preferable in that it improves formability, in consideration of which the above preferable ranges are proposed.

When the soft magnetic alloy is Fe—Cr—Si alloy, the content of Cr is preferably 2.0 to 15 percent by weight, or more preferably 3.0 to 6.0 percent by weight. Presence of Cr is preferable in that it becomes inert under heat treatment to suppress excessive oxidization while expressing strength and insulation resistance, while less Cr is preferable in that it improves magnetic characteristics, in consideration of which the above preferable ranges are proposed.

When the soft magnetic alloy is Fe—Si—Al alloy, the content of Si is preferably 1.5 to 12 percent by weight. A higher Si content is preferable in that it leads to higher resistance and higher magnetic permeability, while a lower Si content is preferable in that it improves formability, in consideration of which the above preferable ranges are proposed.

When the soft magnetic alloy is Fe—Si—Al alloy, the content of Al is preferably 2.0 to 8 percent by weight. The differences between Cr and Al are explained below.

It should be noted that the preferable contents of each metal component in the soft magnetic alloy as mentioned above assume that the total amount of all alloy component represents 100 percent by weight. In other words, oxide film composition is excluded in the calculations of preferable contents above.

When the soft magnetic alloy is Fe—Si-M alloy, preferably the remainder of Si and M is Fe, except for unavoidable impurities. Metals that may be contained other than Fe, Si, and M include magnesium, calcium, titanium, manganese, cobalt, nickel, copper, and the like, while nonmetals that may be contained include phosphorous, sulfur, carbon, and the like.

The chemical composition of the alloy constituting each metal grain 11 in the magnetic material 1 can be calculated, for example, by capturing a cross section of the magnetic material 1 using a scanning electron microscope (SEM) and then calculating the composition by the ZAF method based on energy dispersive X-ray spectroscopy (EDS).

The magnetic material proposed by the present invention can be manufactured by compacting the metal grains constituted by a specific soft magnetic alloy as mentioned above, and then heat-treating the compact. At this time, preferably heat treatment is applied in such a way that, in addition to the oxide film already present on the material metal grain (hereinafter also referred to as "material grain"), some of the parts that were in metal form on the material metal grain would also be oxidized to form oxide film 12. Under the present invention, the oxide film 12 is constituted by an oxide of the alloy grain constituting the metal grain 11, and is formed primarily by means of oxidization of the surface of the metal grain 11. In a favorable embodiment, any oxide other than the one resulting from the oxidization of the metal grain 11, such as silica or any phosphate compound, is not included in the magnetic material conforming to the present invention.

The individual metal grains 11 constituting the magnetic material 1 have oxide film 12 formed at least partially around them. Oxide film 12 may be formed in the material grain stage before the magnetic material 1 is formed, or oxide film may be kept nonexistent or minimal in the material grain stage and generated in the compacting process. Presence of oxide film 12 can be recognized as a contrast (brightness) difference on an image taken by the scanning electron microscope (SEM) at a magnification of around ×3000. Presence of oxide film 12 assures insulation property of the magnetic material as a whole.

Preferably the oxide film 12 contains more of the metal element M than the element Fe in mol conversion. Methods to obtain oxide film 12 having this constitution include keeping the content of Fe oxide in the material grain for magnetic material minimal or zero whenever possible, and oxidizing the alloy surface by heat treatment or other means in the process of obtaining the magnetic material 1. This way, metal M that oxidizes more easily than Fe is selectively oxidized and consequently the mol ratio of metal M in the oxide film 12 becomes relatively greater than Fe. Containing more of the metal element M than the element Fe in the oxide film 12 has the benefit of suppressing excessive oxidization of the alloy grain.

The method of measuring the chemical composition of the oxide film 12 in the magnetic material 1 is as follows. First, the magnetic material 1 is fractured or otherwise its cross section is exposed. Next, the cross section is smoothed by means of ion milling, etc., and then captured with a scanning electron microscope (SEM), followed by chemical composition calculation of the oxide film 12 according to the ZAF method based on energy dispersive X-ray spectroscopy (EDS).

The content of metal M in oxide film 12 is preferably 1.0 to 5.0 mol, or more preferably 1.0 to 2.5 mol, or even more preferably 1.0 to 1.7 mol, per 1 mol of Fe. Any higher content is preferable in terms of suppressing excessive oxidization, while any lower content is preferable in terms of sintering the space between metal grains. Methods to decrease the content include heat-treating in a weak oxidizing ambience, for example, while methods to increase the content include heat-treating in a strong oxidizing ambience, for example.

In the magnetic material 1, grains are bonded together primarily by bonds 22 that interconnect oxide films 12. Presence of bonds 22 that interconnect oxide film 12 can be clearly determined by, for example, visually confirming on a SEM observation image magnified to approx. 3000 times, etc., that the oxide film 12 of a metal grain 11 has the same phase as the oxide film 12 of an adjacent metal grain 11. Presence of bonds 22 that interconnect oxide films 12 improves mechanical strength and insulation property. Preferably adjacent metal grains 11 are bonded together via their oxide film 12 throughout the magnetic material 1, but mechanical strength and insulation property improve to some extent so long as some grains are bonded this way, and such mode is also considered an embodiment of the present invention. Preferably bonds 22 that interconnect oxide films 12 are present by a number equal to or greater than the number of metal grains 11 included in the magnetic material 1. Also, as described later, bonds 21 that interconnect metal grains 11 without bonds that interconnect oxide films 12 may be present in some areas. Furthermore, a mode (not illustrated) in which adjacent metal grains 11 are physically contacting or in close proximity to each other in the absence of bonds that interconnect oxide films 12 or bonds that interconnect metal grains 11 may be allowed in some areas.

Methods to generate bonds 22 that interconnect oxide films 12 include, for example, applying heat treatment at the specific temperature mentioned later in an ambience of oxygen (such as in air) during the manufacture of magnetic material 1.

According to the present invention, the magnetic material 1 not only has bonds 22 that interconnect oxide films 12 but also has bonds 21 that interconnect metal grains 11. As is the case with bonds 22 that interconnect oxide films 12 as mentioned above, presence of bonds 21 that interconnect metal grains 11 can be clearly determined by, for example, visually confirming a bonding point at which adjacent metal grains 11 have the same phase with each other, in a SEM observation image magnified to approx. 3000 times, etc. Magnetic permeability is further improved by the presence of bonds 21 that interconnect metal grains 11.

Methods to generate bonds 21 that interconnect metal grains 11 include, for example, using material grains having less oxide film on them, adjusting the temperature and partial oxygen pressure as described later during the heat treatment needed to manufacture the magnetic material 1, and adjusting the compacting density at which to obtain the magnetic material 1 from the material grains. As for the heat treatment temperature, it can be proposed that it is enough to bond the metal grains 11 together, while keeping the generation of oxide to a minimum. The specific preferable temperature ranges are mentioned later. The partial oxygen pressure may be that in air, for example, and the lower the partial oxygen pressure, the less likely the generation of oxide becomes and consequently the more likely the direct bonding of metal grains 11 becomes.

The magnetic material conforming to the present invention can be manufactured by compacting metal grains constituted by a specific alloy. At this time, a grain compact whose shape is more desirable overall can be obtained by causing adjacent metal grains to bond primarily via oxide film, while allowing them to bond without oxide film in some areas.

For the metal grain (material grain) used as the material when manufacturing the magnetic material proposed by the present invention, preferably a grain constituted by Fe-M-Si alloy, or more preferably by Fe—Cr—Si alloy, is used. The alloy composition of the material grain will be reflected in the alloy composition of the magnetic material eventually obtained. Accordingly, a desired alloy composition can be selected for the material grain as deemed appropriate according to the alloy composition of the magnetic material to be obtained eventually, in which case preferable composition ranges are the same as the preferable composition ranges for the magnetic material as mentioned above. Individual material grains may be covered with oxide film. In other words, individual material grains may be constituted by specific soft magnetic alloy at the center, as well as oxide film which is present at least partially around them and results from the oxidization of the soft magnetic alloy.

The size of each material grain is virtually equivalent to the size of the grain constituting the magnetic material 1 in the magnetic material finally obtained. The size of the material grain is preferably a d50 of 2 to 30 μm, or more preferably that of 2 to 20 μm, when magnetic permeability and in-grain eddy current loss are considered, where a more preferable lower limit of d50 is 5 μm. The d50 of the material grain can be measured using a laser diffraction/scattering measuring system.

The material grain is manufactured by the atomization method, for example. As mentioned earlier, the magnetic material 1 not only has bonding parts 22 via oxide film 12, but it also has bonding parts 21 where metal grains 11 are directly bonded together. Accordingly, oxide film may be present on the material grain, but not excessively. The grain manufactured by the atomization method is preferred in that it has relatively less oxide film. The ratio of alloy core and oxide film in the material grain can be quantified as follows. The material grain is analyzed by XPS by focusing on the peak intensity of Fe, and the integral value of peaks at which Fe exists as metal (706.9 eV), or $Fe_{Metal}$, and integral value of peaks at which Fe exists as oxide, or $Fe_{Oxide}$, are obtained, after which $Fe_{Metal}/(Fe_{Metal}+Fe_{Oxide})$ is calculated to quantify the ratio. Here, the calculation of $Fe_{Oxide}$ involves fitting with the measured data based on normal distribution layering around the binding energies of three types of oxides, namely $Fe_2O_3$ (710.9 eV), FeO (709.6 eV) and $Fe_3O_4$ (710.7 eV). As a result, $Fe_{Oxide}$ is calculated as the sum of integral areas isolated by peaks. Preferably the above value is 0.2 or greater from the viewpoint of enhancing the magnetic permeability as a result of promoting the generation of alloy-alloy bonding parts 21 during heat treatment. The upper limit of the above value is not specified in any way, but it can be 0.6, for example, from the viewpoint of manufacturing ease, and a preferable upper limit is 0.3. Methods to raise the above value include heat-treating in a reducing ambience, removing the surface oxide layer using acid, or applying other chemical treatment, for example. Reduction process can be implemented by, for example, holding the target at 750 to 850° C. for 0.5 to 1.5 hours in an ambience of nitrogen or argon containing 25 to 35% of hydrogen. Oxidization process can be implemented by, for example, holding the target at 400 to 600° C. for 0.5 to 1.5 hours in air.

For the aforementioned material grain, any known alloy grain manufacturing method may be adopted, or PF20-F by Epson Atmix, SFR-FeSiAl by Nippon Atomized Metal Powders or other commercial product may be used. If a commercial product is used, it is highly likely that the aforementioned value of $Fe_{Metal}/(Fe_{Metal}+Fe_{Oxide})$ is not considered and therefore it is preferable to screen material grains or apply the aforementioned heat treatment, chemical treatment, or other pretreatment.

The method to obtain a compact from the material grain is not limited in any way, and any known means for magnetic material manufacturing can be adopted as deemed appropriate. The following explains a typical manufacturing method of compacting the material grains under non-heating conditions and then applying heat treatment. However, the present invention is not at all limited to this manufacturing method.

When compacting the material grains under non-heating conditions, it is preferable to add organic resin as binder. For the organic resin, it is preferable to use one constituted by PVA resin, butyral resin, vinyl resin, or other resin whose thermal decomposition temperature is 500° C. or below, as less binder will remain after the heat treatment. Any known lubricant may be added at the time of compacting. The lubricant may be organic acid salt, etc., where specific examples include zinc stearate and calcium stearate. The amount of lubricant is preferably 0 to 1.5 parts by weight, or more preferably 0.1 to 1.0 parts by weight, or even more preferably 0.15 to 0.45 parts by weight, or most preferably 0.15 to 0.25 parts by weight, relative to 100 parts by weight of material grains. When the amount of lubricant is zero, it means lubricant is not used at all. The material grains are mixed with any binder and/or lubricant, and the mixture is agitated and then compacted into a desired shape. Compacting involves applying 2 to 20 ton/cm$^2$ of pressure at a compacting temperature of 20 to 120° C., among others.

A favorable embodiment of heat treatment is explained.

Preferably heat treatment is performed in an oxidizing ambience. To be more specific, the oxygen concentration is preferably 1% or more during heating, as it promotes the generation of both bonds 22 that interconnect oxide films and bonds 21 that interconnect metals. Although the upper limit of oxygen concentration is not specified in particular, the oxygen concentration in air (approx. 21%) may be used, for example, in consideration of manufacturing cost, etc. The heating temperature is preferably 600° C. or above from the viewpoint of generating oxide film 12 and thereby promoting the generation of bonds that interconnect oxide films 12, and 900° C. or below from the viewpoint of suppressing oxidization to an appropriate level in order to maintain bonds 21 that interconnect metals and thereby enhance magnetic permeability. More preferably the heating temperature is 700 to 800° C. Preferably the heating time is 0.5 to 3 hours from the viewpoint of promoting the generation of both bonds 22 that interconnect oxide films 12 and bonds 21 that interconnect metals. The mechanism by which bonds via oxide film 12 and bonds 21 where metal grains are directly bonded together generate is considered similar to the mechanism of the so-called ceramic sintering that occurs in a high temperature range of 600° C. or so. In other words, according to the new knowledge gained by the inventors of the present invention, important points of this heat treatment are as follows: (A) oxide film is fully in contact with oxidizing ambience and the metal element is supplied by the metal grains as necessary to allow the oxide film to grow; and (B) adjacent oxide films are in direct contact with each other to allow the substance constituting the oxide film to diffuse to each other. Accordingly, preferably virtually none of the thermosetting resin, silicone, etc., that may remain in a high temperature range of 600° C. or above is present at the time of heat treatment.

The obtained magnetic material 1 has voids 30 present inside. Resin material is filled at least in some of these voids 30. Methods to fill resin material include, for example, soaking the magnetic material 1 in resin material in liquid state, solution of resin material or other liquefied resin material and then lowering the pressure of the manufacturing system, or applying the aforementioned liquefied resin material onto the magnetic material 1 and letting it seep into the voids 30 near the surface. Filling resin material 31 in the voids 30 in the magnetic material 1 is beneficial in that it increases strength and suppresses hygroscopic property, and specifically as water no longer enters the magnetic material easily at high humidity, insulation resistance does not drop easily. The resin material 31 is not limited in any way and may be any organic resin, silicone resin, etc., and preferably it is constituted by at least one type of resin material selected from a group that includes silicone resin, epoxy resin, phenolic resin, silicate resin, urethane resin, imide resin, acrylic resin, polyester resin, and polyethylene resin.

Figure 2:
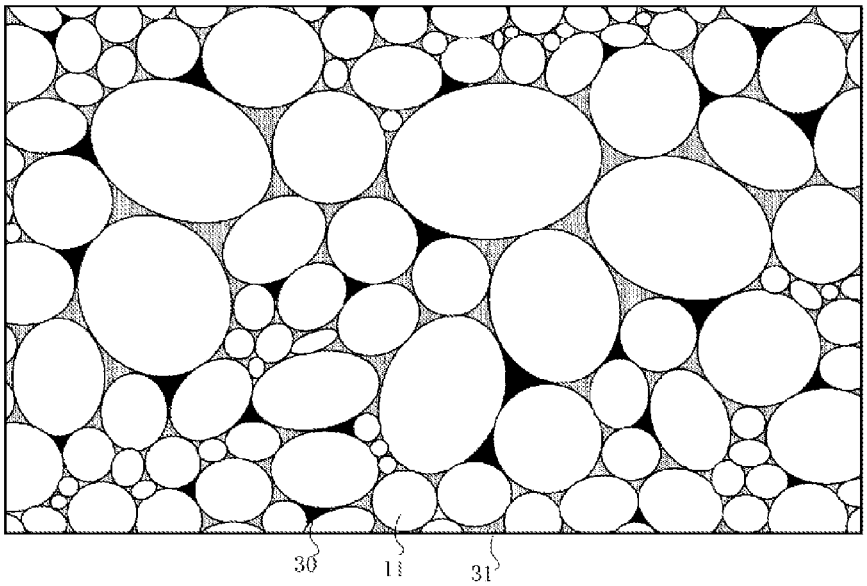
[FIG. 2] This is a section view providing a schematic illustration of magnetic material conforming to the present invention.

Preferably the resin material is filled in such a way as to occupy a specific percentage or more of the voids generating in the magnetic material. The filling level of resin material is quantified by mirror-surface-polishing the laminated inductor to be measured, ion-milling (CP) the mirror surface, and observing the milled surface using a scanning electron microscope (SEM). To be specific, the following process is followed. First, the measuring target is polished so as to expose a cross section obtained by cutting through the center of the laminate in a thickness direction. On the obtained cross section, an area near the center of the product is then captured with a scanning electron microscope (SEM) at a magnification of ×3000, to obtain a secondary microgram and composition image. FIG. 2 is a schematic drawing of the obtained image. The observed image shows contrast differences in the composition image due to different constituent elements. The metal grain 11, oxide film (not illustrated), resin-material filled area 31, and void 30, are identified in the order of high to low contrast. From the observed image, the percentage of the area of voids 30 relative to the area corresponding to regions where neither the metal grain 11 nor oxide film is present is calculated, and this percentage is defined as the void ratio. The resin fill ratio (%) is then calculated by (100−Void ratio). For the benefits of the present invention to become more effective, preferably the resin fill ratio is 15% or more.

According to the present invention, a magnetic material constituted by such magnetic material 1 can be used as a constituent of various electronic components. For example, the magnetic material conforming to the present invention may be used as a core, with an insulating sheathed conductive wire wound around it, to form a coil. Or, green sheets containing the aforementioned material grains may be formed using any known method, followed by printing or otherwise applying a conductive paste onto the green sheets in a specific pattern and then laminating the printed green sheets and pressurizing the laminate, followed further by heat treatment under the aforementioned conditions, to obtain an inductor (coil component) having a coil formed inside the magnetic material constituted by a grain compact and conforming to the present invention. In addition, various coil components may be obtained by forming a coil inside or on the surface of the magnetic material conforming to the present invention. The coil component can be any of the various mounting patterns such as surface mounting and through hole mounting, and for the means to obtain a coil component from the magnetic material, including the means to constitute the coil component of any such mounting pattern, any manufacturing method in the electronics component field may be adopted as deemed appropriate. For example, an embodiment in which the coil component is a laminated inductor is illustrated later in "Examples."

Figure 3:
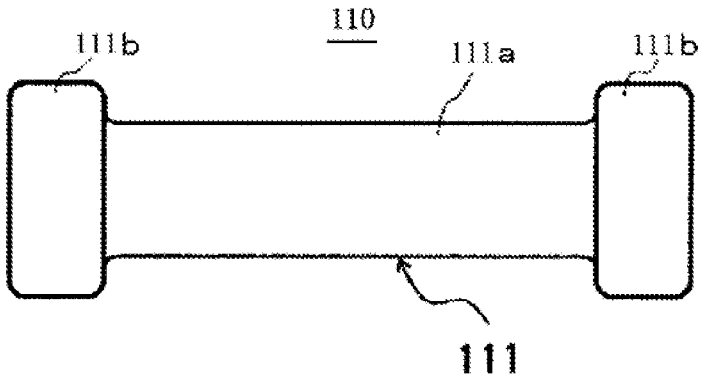
[FIG. 3] This is a side view showing the exterior of an example of magnetic material of the present invention.
Figure 4:
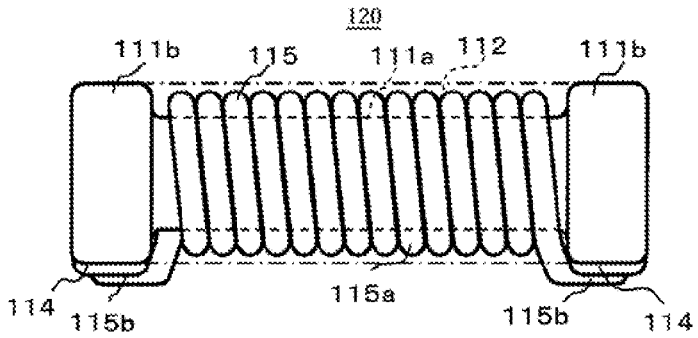
[FIG. 4] This is a perspective side view showing a part of the example of coil component of the present invention.
Figure 5:
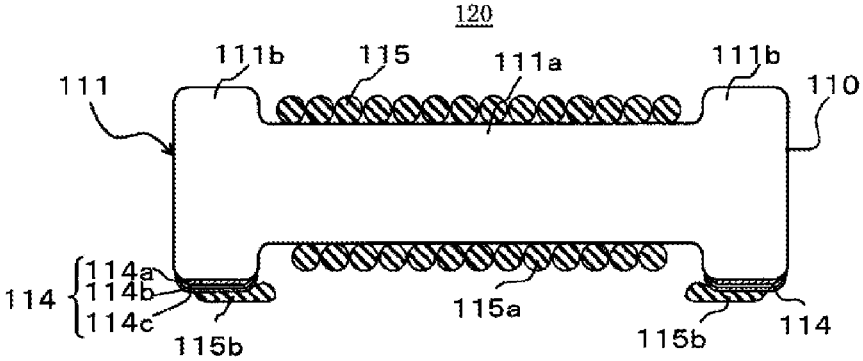
[FIG. 5] This is a longitudinal section view showing the internal structure of the coil component in FIG. 4.

An example of a coil component is shown. FIG. 3 is a side view showing the exterior of an example of magnetic material conforming to the present invention. FIG. 4 is a perspective side view showing a part of the example of a coil component. FIG. 5 is a longitudinal section view showing the internal structure of the coil component in FIG. 4. A magnetic material 110 shown in FIG. 3 is used as a magnetic core around which the coil of the coiled chip inductor is wound. A drum-shaped magnetic core 111 has a plate-like winding core 111*a* placed in parallel with the mounting surface of the circuit board, etc., and used to wind the coil around it, as well as a pair of flanges 111*b* placed on the opposing ends of the winding core 111*a*, respectively, and its exterior has a drum shape. The ends of the coil are electrically connected to external conductive films 114 formed on the surfaces of the flanges 111*b*.

A coiled chip inductor 120, which is a coil component, has the aforementioned magnetic core 111 and a pair of plate-like magnetic cores 112 not illustrated. The magnetic core 111 and plate-like magnetic cores 112 are constituted by the magnetic material 110 of the present invention. The plate-like magnetic cores 112 connect the two flanges 111*b*, 111*b* of the magnetic core 111, respectively. A pair of external conductive films 114 are formed on the mounting surfaces of the flanges 111*b* of the magnetic core 111, respectively. Also, a coil 115 constituted by an insulating sheathed conductive wire is wound around the winding core 111*a* of the magnetic core 111 to form a winding part 115*a*, while two ends 115*b* are thermocompression-bonded to the external conductive films 114 on the mounting surfaces of the flanges 111*b*, respectively. The external conductive film 114 has a baked conductive layer 114*a* formed on the surface of the magnetic material 110, as well as a Ni plating layer 114*b* and Sn plating layer 114*c* laminated on this baked conductive layer 114*a*. The aforementioned plate-like magnetic cores 112 are bonded to the flanges 111*b*, 111*b* of the magnetic core 111 by resin adhesive. The external conductive film 114 is formed on the surface of the magnetic material 110, and the end of the magnetic core is connected to the external conductive film 114. The external conductive film 114 was formed by baking a glass-added silver paste onto the magnetic material 110 at a specified temperature.

When this coil component is manufactured, preferably the resin material is filled in the voids in the magnetic material constituting the magnetic core 111 before the coil 115 is wound.

EXAMPLES

The present invention is explained specifically below using examples. It should be noted, however, that the present invention is not at all limited to the embodiments described in these examples.

Examples 1~6

(Material Grain)

A commercial alloy powder manufactured by the atomization method, having a composition of 4.5 percent by weight of Cr, 3.5 percent by weight of Si and Fe constituting the remainder, and average grain size d50 of 6 μm, was used as the material grain. An aggregate surface of this alloy powder was analyzed by XPS and the aforementioned $Fe_{Metal}/(Fe_{Metal}+Fe_{Oxide})$ was calculated as 0.25.

In this example, a laminated inductor was manufactured as a coil component.

Figure 6:
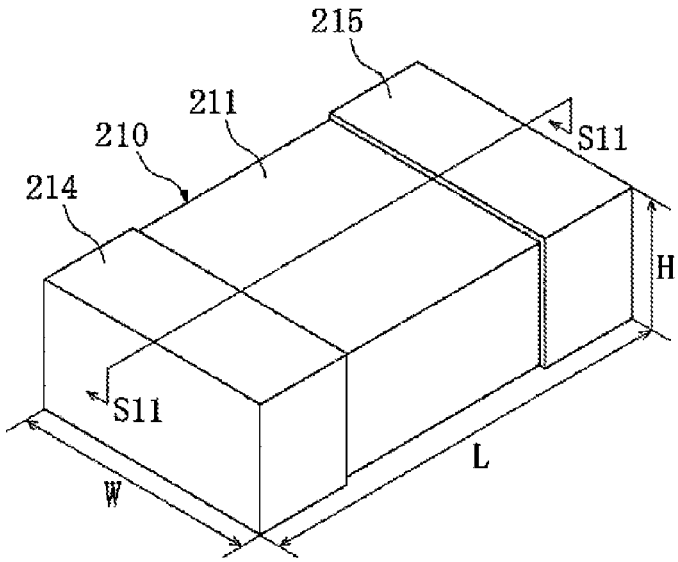
[FIG. 6] This is a perspective view of the exterior of a laminated inductor.
Figure 7:
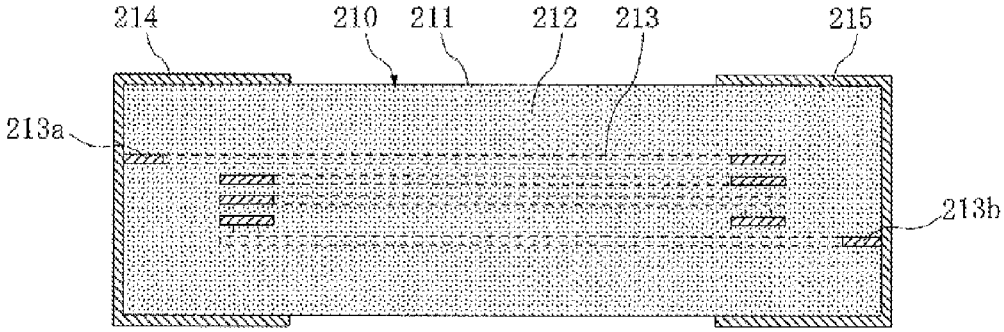
[FIG. 7] This is an enlarged section view of FIG. 6, cut along line S11-S11.
Figure 8:
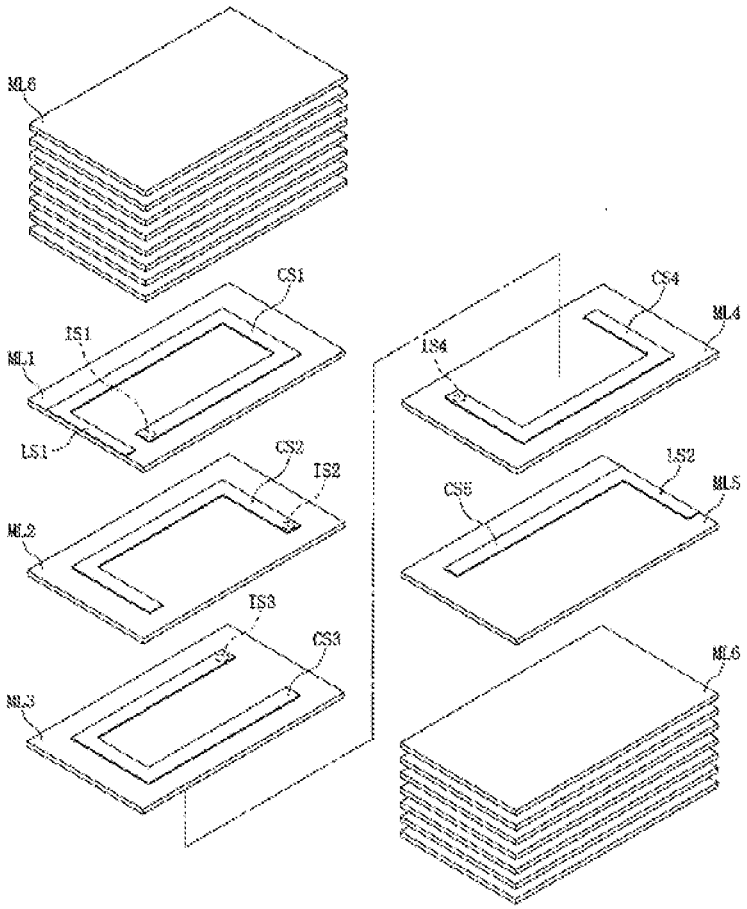
[FIG. 8] This is an exploded view of the component body shown in FIG. 6.
Figure 9:
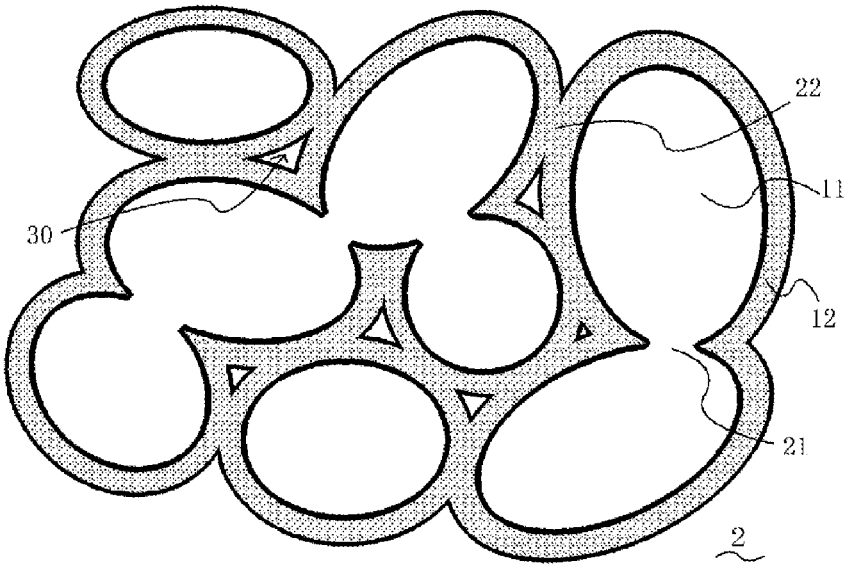
[FIG. 9] This is a section view providing a schematic illustration of the fine structure of the magnetic material in a comparative example.

FIG. 6 is a perspective view of the exterior of a laminated inductor. FIG. 7 is an enlarged section view of FIG. 6, cut along line S11-S11. FIG. 8 is an exploded view of the component body shown in FIG. 6. A laminated inductor 210 manufactured in this example has an overall shape of a rectangular solid with a length L of approx. 3.2 mm, width W of approx. 1.6 mm and height H of approx. 0.8 mm, in FIG. 6. This laminated inductor 210 comprises a component body 211 of rectangular solid shape, as well as a pair of external terminals 214, 215 provided on both longitudinal ends of the component body 211. As shown in FIG. 7, the component body 211 has a magnetic material part 212 of rectangular solid shape, and a spiral coil 213 covered with the magnetic material part 212, with one end 213*a* of the coil 213 connected to the external terminal 214 and the other end 213*b* connected to the external terminal 215. As shown in FIG. 8, the magnetic material part 212 has a structure of a total of 20 magnetic layers ML1 to ML6 integrated together, where the length is approx. 3.2 mm, width is approx. 1.6 mm, and height is approx. 0.8 mm. The magnetic layers ML1 to ML6 each have a length of approx. 3.2 mm, width of approx. 1.6 mm, and thickness of approx. 40 μm. The coil 213 has a structure of a total of five coil segments CS1 to CS5, and a total of four relay segments IS1 to IS4 connecting the coil segments CS1 to CS5, integrated together in a spiral form, where the number of windings is approx. 3.5. The material for this coil 213 is an Ag grain whose d50 is 5 μm.

The four coil segments CS1 to CS4 have a U shape, and the one coil segment CS5 has a band shape. The coil segments CS1 to CS5 each have a thickness of approx. 20 μm and width of approx. 0.2 mm. The top coil segment CS1 has, as a continuous part, an L-shaped leader part LS1 used to connect to the external terminal 214, while the bottom coil segment CS5 has, as a continuous part, an L-shaped leader part LS2 used to connect to the external terminal 215. The relay segments IS1 to IS4 each have a columnar shape penetrating the magnetic layers ML1 to ML4, and each have a bore of approx. 15 μm. The external terminals 214, 215 each extend to each longitudinal end face of the component body 211 and the four side faces near the end face, and each have a thickness of approx. 20 μm. The one external terminal 214 connects to the edge of the leader part LS1 of the top coil segment CS1, while the other external terminal 215 connects to the edge of the leader part LS2 of the bottom coil segment CS5. The material for these external terminals 214, 215 is an Ag grain whose d50 is 5 μm.

In manufacturing the laminated inductor 210, a doctor blade was used as a coater to apply a premixed magnetic paste onto the surfaces of plastic base films (not illustrated) and then dried using a hot-air dryer under the conditions of approx. 80° C. for approx. 5 minutes, to prepare first through sixth sheets, respectively corresponding to the magnetic layers ML1 to ML6 (refer to FIG. 8) and having an appropriate size for multi-part forming. The magnetic paste contained the material grain mentioned above by 85 percent by weight, butyl carbitol (solvent) by 13 percent by weight, and polyvinyl butyral (binder) by 2 percent by weight. Next, a stamping machine was used to puncture the first sheet corresponding to the magnetic layer ML1, to form through holes in a specific arrangement corresponding to the relay segment IS1. Similarly, through holes corresponding to the relay segments IS2 to IS4 were formed in specific arrangements in the second through fourth sheets corresponding to the magnetic layers ML2 to ML4.

Next, a screen printer was used to print a premixed conductive paste onto the surface of the first sheet corresponding to the magnetic layer ML1 and then dried using a hot-air dryer under the conditions of approx. 80° C. for approx. 5 minutes, to prepare a first printed layer corresponding to the coil segment CS1 in a specific arrangement. Similarly, second through fifth printed layers corresponding to the coil segments CS2 to CS5 were prepared in specific arrangements on the surfaces of the second through fifth sheets corresponding to the magnetic layers ML2 to ML5. The composition of the conductive paste was 85 percent by weight of Ag material, 13 percent by weight of butyl carbitol (solvent) and 2 percent by weight of polyvinyl butyral (binder). Since the through holes formed in specific arrangements in the first through fourth sheets corresponding to the magnetic layers ML1 to ML4, respectively, are positioned in a manner overlapping with the ends of the first through fourth printed layers in specific arrangements, respectively, the conductive paste is partially filled in each through hole when the first through fourth printed layers are printed, and first through fourth fill parts corresponding to the relay segments IS1 to IS4 are formed as a result.

Next, a pickup transfer machine and press machine (both are not illustrated) were used to stack the first through fourth sheets having printed layers and fill parts on them (corresponding to the magnetic layers ML1 to ML4), fifth sheet having only a printed layer on it (corresponding to the magnetic layer ML5), and sixth sheet having no printed layer or fill area on it (corresponding to the magnetic layer ML6), in the order shown in FIG. 8, after which the stacked sheets were thermocompression-bonded to prepare a laminate. Next, a dicer was used to cut the laminate to the component body size to prepare a chip-before-heat-treatment (including the magnetic material part and coil before heat treatment). Next, a sintering furnace, etc., was used to heat multiple chips-before-heat-treatment in batch in an atmospheric ambience. This heat treatment included a binder removal process and oxide film forming process, where the binder removal process was implemented under the conditions of approx. 300° C. for approx. 1 hour, while the oxide film forming process was implemented under the conditions of approx. 750° C. for approx. 2 hours. Next, a dip coater was used to apply the aforementioned conductive paste onto both longitudinal ends of the component body 211 and then baked in a sintering furnace under the conditions of approx. 600° C. for approx. 1 hour, thereby eliminating the solvent and binder while sintering the Ag grains through the baking process, to prepare external terminals 214, 215.

Next, the laminated inductor was soaked in the solution containing each resin material to fill the resin material in the voids, followed by heat treatment at 150° C. for 60 minutes, to harden the resin material. The types and filling levels of resin materials are as shown in Table 1. The filling level was controlled by means of adjusting the dilution concentration and viscosity of the resin. In Table 1, "Silicone type" represents resin having the basic structure of (1) below, while "Epoxy type" represents resin having the basic structure of (2) below.

[Chemical Structure 1]

(1)

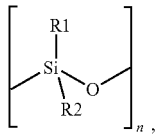

(2)

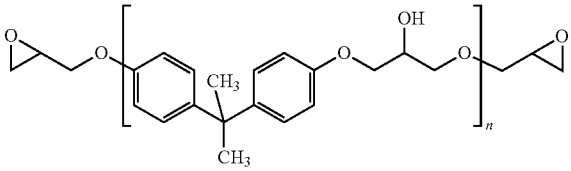

SEM observation (at ×3000) of a cross section of the obtained laminated inductor confirmed presence of bonding parts where metal grains constituted by the soft magnetic alloy are bonded together via the oxide film formed on their surface, as well as bonding parts where metal grains are directly bonded together in areas having no oxide film.

Comparative Example 1

A laminated inductor was manufactured in the same manner as in the examples, except that resin material was not filled. FIG. 6 shows a schematic section view of the magnetic material layer in the comparative example. With this magnetic material 2, resin material is not filled in regions where neither the metal grain 11 nor oxide film 12 is present, and voids 30 remain as a result.

[Evaluation]

The laminated inductors obtained in the examples and the comparative example were put through the following reliability tests (n=100) at L=1.0 uH, Q (1 MHz)=30, and Rdc=0.1Ω:

(1) High-temperature load test: 85° C., 0.8 A applied, 1000 hours (2) Accelerated load test: 85° C., 1.2 A applied, 300 hours (3) Moisture-resistant load test: 60° C., humidity 95%, 0.8 A applied, 300 hours After the end of each test, the sample was judged defective if L or Q had dropped to 70% of the initial value or below.

Furthermore, the coefficient of water absorption of the magnetic material part was measured on the laminated inductors obtained in the examples and comparative example. The coefficient of water absorption was obtained by soaking the sample in boiling water for 3 hours and then dividing the difference between the mass after water absorption and total dry mass, by the total dry mass. Table 1 lists the manufacturing conditions and measured results of percent defective and coefficient of water absorption.

TABLE 1

| | Type of resin | Fill ratio | Percent defective in high-temperature load test | Percent defective in accelerated load test | Percent defective in moisture-resistant load test | Coefficient of water absorption |
|---|---|---|---|---|---|---|
| Comparative example | None | 0% | 90% | 80% | 95% | 18% |
| Example 1 | Silicone type | 5% | 10% | 10% | 10% | 12% |
| Example 2 | | 15% | <1% | 0% | <1% | 4% |
| Example 3 | | 20% | 0% | 0% | 0% | 2% |
| Example 4 | Epoxy type | 5% | 15% | 10% | 15% | 13% |
| Example 5 | | 15% | <1% | 0% | <1% | 5% |
| Example 6 | | 20% | 0% | 0% | 0% | 2% |

As mentioned above, the examples where resin was filled resulted in a lower coefficient of moisture absorption representing improved reliability, and this effect was particularly evident when the fill ratio was 15% or more.

DESCRIPTION OF THE SYMBOLS

1, 2: Magnetic material, 11: Metal grain, 12: Oxide film, 21: Bonding part where metal grains are directly bonded together, 22: Bonding part via oxide film, 30: Void, 31: Polymer resin, 110: Magnetic material, 111, 112: Magnetic core, 114: External conductive film, 115: Coil, 210: Laminated inductor, 211: Component body, 212: Magnetic material part, 213: Coil, 214, 215: External terminal

What is claimed is:

1. A magnetic material that has multiple metal grains constituted by Fe—Si-M soft magnetic alloy (where M is a metal element that oxidizes more easily than Fe), as well as oxide film constituted by an oxide of the soft magnetic alloy and formed on a surface of the metal grains, wherein the magnetic material has bonding parts where adjacent metal grains are bonded together via the oxide film formed on their surface, as well as bonding parts where metal grains are directly bonded together in areas having no oxide film, and resin material is filled in at least some of voids generating as a result of accumulation of the metal grains.

2. A magnetic material according to claim 1, wherein the resin material is filled in regions whose area corresponds to 15% or more of an area of regions where neither the metal grain nor oxide film is present, as observed on a cross section of the magnetic material.

3. A magnetic material according to claim 1, wherein the resin material is constituted by at least one type of resin selected from a group that includes silicone resin, epoxy resin, phenolic resin, silicate resin, urethane resin, imide resin, acrylic resin, polyester resin and polyethylene resin.

4. A coil component having the magnetic material according to claim 1, and a coil formed inside or on a surface of the magnetic material.

5. A magnetic material according to claim 2, wherein the resin material is constituted by at least one type of resin selected from a group that includes silicone resin, epoxy resin, phenolic resin, silicate resin, urethane resin, imide resin, acrylic resin, polyester resin and polyethylene resin.

6. A coil component having the magnetic material according to claim 2, and a coil formed inside or on a surface of the magnetic material.

7. A coil component having the magnetic material according to claim 3, and a coil formed inside or on a surface of the magnetic material.

8. A coil component having the magnetic material according to claim 5, and a coil formed inside or on a surface of the magnetic material.

* * * * *

UNITED STATES PATENT AND TRADEMARK OFFICE

CERTIFICATE OF CORRECTION

PATENT NO. : 9,287,026 B2
APPLICATION NO. : 14/114138
DATED : March 15, 2016
INVENTOR(S) : Hitoshi Matsuura, Masahiro Hachiya and Kenji Otake It is certified that error appears in the above-identified patent and that said Letters Patent is hereby corrected as shown below:

Specification

At column 2, line 6, in "Fe—Si-M", please delete the "—" and insert therefor a -- - -- to read --Fe-Si-M--.

Claims

At column 13, line 29, in Claim 1, in "Fe—Si-M", please delete the "—" and insert therefor a -- - -- to read --Fe-Si-M--.

Signed and Sealed this
Seventeenth Day of May, 2016

Michelle K. Lee

Michelle K. Lee
*Director of the United States Patent and Trademark Office*